US005388332A

United States Patent [19]

Oldroyd

[11] Patent Number: 5,388,332

[45] Date of Patent: Feb. 14, 1995

[54] RAZOR BLADE UNITS AND BLADE SPACERS THEREFOR

[75] Inventor: Brian Oldroyd, Reading, United Kingdom

[73] Assignee: The Gillette Company, Boston, Mass.

[21] Appl. No.: 30,080

[22] PCT Filed: Oct. 11, 1991

[86] PCT No.: PCT/US91/07598

§ 371 Date: May 27, 1993

§ 102(e) Date: May 27, 1993

[87] PCT Pub. No.: WO92/06828

PCT Pub. Date: Apr. 30, 1992

[30] Foreign Application Priority Data

Oct. 22, 1990 [GB] United Kingdom ..... 9022936

[51] Int. Cl.[6] ..... B26B 21/40

[52] U.S. Cl. ..... 30/50; 30/49

[58] Field of Search ..... 30/50, 47, 49, 77

[56] References Cited

U.S. PATENT DOCUMENTS

| | | | |
|---|---|---|---|
| 2,319,980 | 5/1943 | Des Vardins | 30/50 X |
| 3,890,704 | 1/1975 | Ferraso . | |
| 4,069,580 | 1/1978 | Cartwright . | |
| 4,272,885 | 6/1981 | Ferraro | 30/50 X |
| 4,443,939 | 4/1984 | Motta . | |
| 4,516,320 | 5/1985 | Peleckis | 30/49 |
| 4,641,429 | 2/1987 | Abatemarco . | |
| 4,854,043 | 8/1989 | Chen . | |
| 5,276,967 | 1/1994 | Ferraro et al. | 30/49 |

*Primary Examiner*—Rinaldi I. Rada
*Attorney, Agent, or Firm*—Donal B. Tobin

[57] ABSTRACT

In or for use in a razor blade unit having two parallel blades (14) and an interposed spacer (15), a flexible spacer having spaced transverse ribs with the ribs on one side offset from the ribs on the other side.

6 Claims, 1 Drawing Sheet

RAZOR BLADE UNITS AND BLADE SPACERS THEREFOR

BACKGROUND OF THE INVENTION

This invention is concerned with spacers for flexible razor blade units comprising two blades in tandem, with flexible razor blade units comprising such spacers, and with safety razors comprising such blade units.

Tandem razor blade units which are flexible, in response to forces encountered during normal use, about an axis or axes parallel with the plane of the blades and extending substantially perpendicularly to the cutting edges of the blades have been described in a number of patent specifications, for example, British Specifications 1589591 and 2119690.

The flexibility of such a blade unit can be assured by the design of the moulded plastics housing in which the blades and spacer are mounted, by the use of blades which are thinner than conventional, and by the design and material of the blade spacer. The spacers which are conventionally used in non-flexible blade units are formed of 0.02 inch (0.51 mm) thick aluminum; the use of such a spacer in a blade unit which was, in other respects, flexible would stiffen it to such an extent that it would not flex in shaving and it has accordingly been recognised that in a flexible blade unit, the spacer should be made of a flexible, preferably plastics, material.

We have now developed spacers which provide tandem razor blade units with improved flexibility.

SUMMARY OF THE INVENTION

According to the present invention, there is provided a spacer for a flexible razor blade unit comprising two blades in tandem, which comprises a flexible plastics strip having a length and width appropriate to the blades with which it is to be used, the major surfaces of the strip being formed with transverse ribs, the ribs on one side of the strip being offset with respect to those on the other side and the thickness of the strip and two ribs being greater than the desired separation of the blades.

According to another aspect of the invention, there is provided a flexible tandem razor blade unit, which comprises a flexible moulded plastics housing providing a guard portion and a cap portion and in which tandem blades and a spacer according to the invention therebetween, are clamped under compression.

In such a unit, the guard portion and the cap portion preferably have a comb-like form, the teeth of the two comb-like portions being interconnected by a web which is sufficiently thin as to be flexible.

According to a further aspect of the invention, there is provided a safety razor comprising a flexible tandem blade unit according to the invention, a handle, and connecting means connecting the blade unit to the handle which means permit flexing of the blade unit.

The spacer according to the invention is preferably formed of polyethylene. In addition to its cheapness and good moulding properties, polyethylene has the advantage of a very low coefficient of friction against steel so that the blades can move easily against the spacer as the blade unit is flexed. It is preferred that the height of the ribs should be such that the thickness of the strip and two ribs should be greater than the desire separation of the blades by less than the height of a rib.

For the better understanding of the invention, a currently preferred embodiment thereof will now be described, by way of example, with reference to the accompanying drawings, in which:

DETAILED DESCRIPTION OF THE PREFERRED EMBODIMENT

Figure 1:
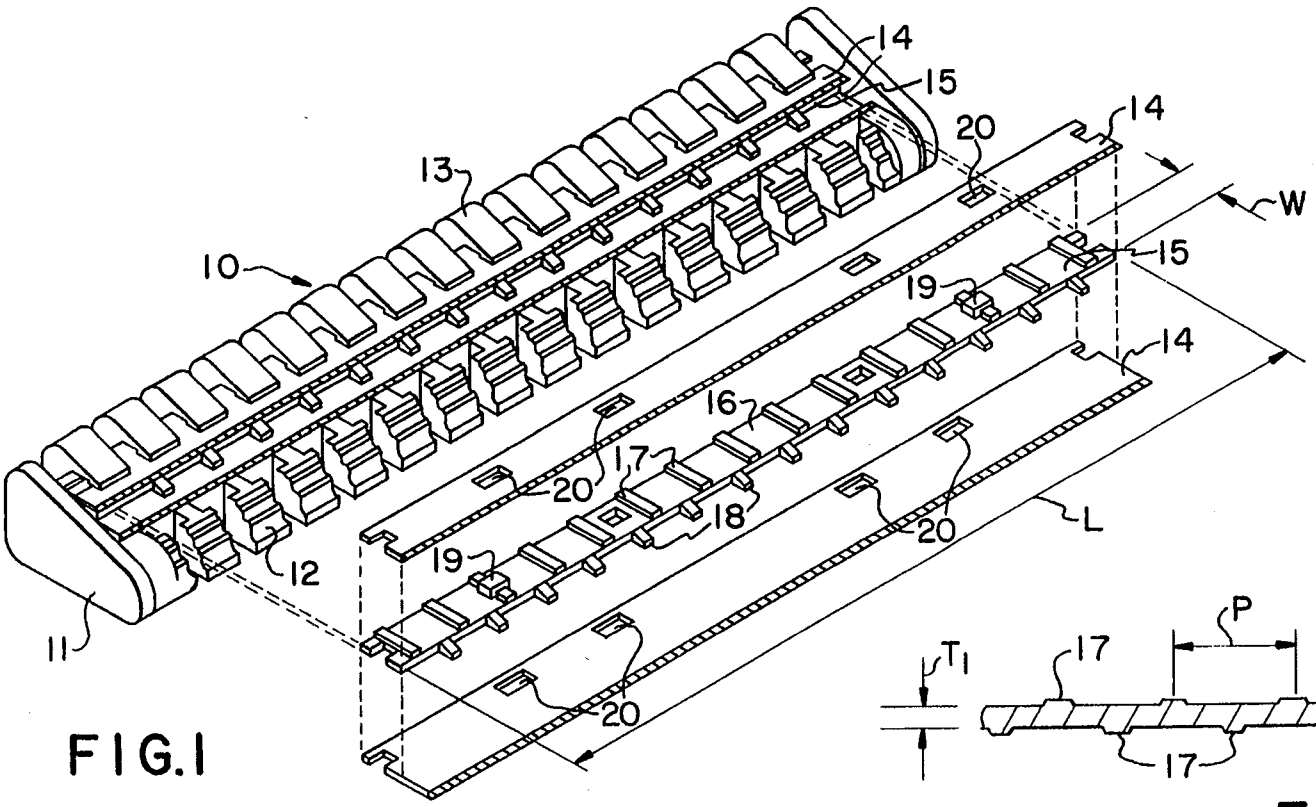
FIG. 1 is a perspective view of a flexible tandem razor blade unit which also show the blades and spacer thereof prior to assembly in the unit.
Figure 2:
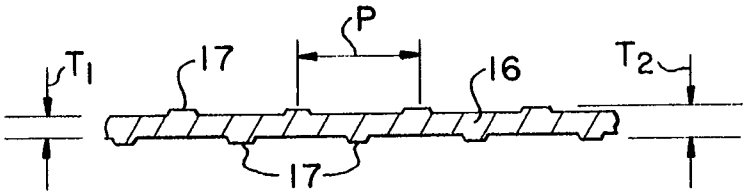
FIG. 2 is a partial longitudinal section of the spacer shown in FIG. 1.

Referring to the drawings, a flexible tandem razor blade unit 10 comprises a flexible moulded plastics housing 11 providing a guard portion 12 and a cap portion 13 and in which tandem blades 14 and a spacer 15 therefor, are clamped under compression. The spacer 15 is a flexible plastics strip 16 of moulded polyethylene having a length and width appropriate to the blades with which it is to be used, for example, a length L of 37.50 mm and a width W of 2.04 mm. Both sides of the strip are provided with integrally moulded transverse ribs 17, the ribs on one side being offset with respect to those on the other side (see FIG. 2). One long edge of the strip 16 is provided with spaced teeth 18 lying in the plane of the strip.

In a particular embodiment the ribs 17 are separated from each other by a distance P of 2.5 mm, the thickness $T_1$ of the strip 16 is 0.30 mm and thickness $T_2$ of the strip and two ribs is 0.51 mm, so that the height of each rib is 0.105 mm.

Figure 3:
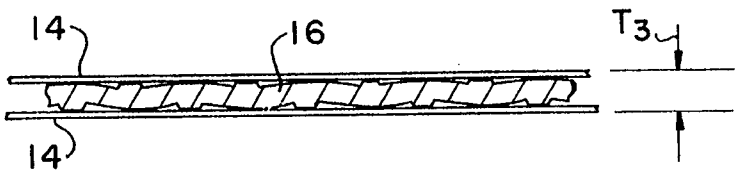
FIG. 3 is a partial longitudinal section of the blades and spacer shown in FIG. 1 as clamped in the unit.

In this embodiment, the spacer is used with blades 14 having a thickness of 0.0813 mm so that the uncompressed thickness of the assembly is 0.51 mm$+2\times$0.0813 mm, that is 0.6726 mm. When mounted in the housing 11 this assembly is compressed to the form shown in FIG. 3 and has a thickness $T_3$ of 0.64 mm, that is there is interference of about 0.033 mm to give blade clamping.

The blades 14 and the spacer 15 are retained in the correct position in the unit 10 by protrusions (not shown) in the housing 11 and protrusions 19 on the spacer which engage in slots 20 in the blades. Slots are used so as to allow relative movement of the blades and spacer during flexing.

The offset rib arrangement in the spacer according to the invention provides good compressibility and thus facilitates assembly of the blade units and improves blade clamping. This arrangement is also such that friction between the spacer and the blades during flexing is minimized by the fact that the area of contact is substantially only the surfaces of the ribs 17.

When the blade unit shown in the drawing is connected to a handle by means permitting flexing of the blade unit, it is found that the latter has excellent flexibility.

I claim:

1. In a razor blade unit including:

a first flexible blade with an edge and having a length and a width and a bottom surface;

a second flexible blade with an edge and having a length substantially equal to the length of said first blade and having a width and a top surface;

said first blade bottom surface and said second blade top surface disposed in facing relationship and said edges of said blades facing in the same direction and aligned generally parallel to one another; and a spacer disposed between said blades and having a generally rectangular cross-section with a top, bottom, front, and back surface, said top surface facing said first blade bottom surface, with said bottom spacer surface facing said second blade top surface, with said front spacer surface facing in the same direction as said edges;

said spacer having a length about equal to the length of said blades and having a width;

THE IMPROVEMENT COMPRISING:

said spacer being flexible about an axis generally parallel to the longer dimension of the rectangular cross-section of said spacer;

a plurality of ribs integral with said spacer and spaced along the top thereof, each rib having the same height;

a second plurality of ribs spaced along the bottom of said spacer each having the same height and offset between said top ribs;

said blades, when assembled into the blade unit, having a desired separation between said facing blade surfaces less than the thickness of said spacer plus the thickness of the top rib and the thickness of the bottom rib;

when said spacer and two blades are spaced the desired distance apart in close contacting relationship, said spacer deforms along its length to form a serpentine shape with said top and bottom ribs touching the respectively opposed bottom surface of said top blade and top surface of said second blade.

2. In a razor blade unit according to claim 1, the thickness of the spacer including the top and bottom ribs is greater than the desired separation of the blades by less than the height of a rib.

3. In a razor blade unit according to claim 1, one of the front and back surface of the spacer is formed with spaced teeth lying in the plane of the spacer.

4. In a razor blade unit according to claim 1, the spacer is formed of polyethylene.

5. The razor blade unit of claim 1 further including at least two protrusions on each of said top surface and said bottom surface of said spacer, each of said protrusions having a height and having a length in a direction along the length of said spacer;

said first blade having recesses in its bottom surface aligned with said spacer protrusions;

said second blade having recesses in its top surface aligned with said confronting protrusions from said spacer;

said blade recesses having a length greater than the length of its corresponding protrusion;

so that as said blades flex said protrusions are free to move along said recesses to allow each blade and said spacer to bend as a unit while allowing relative translational movement along the length of the spacer among said first and second blades and said spacer.

6. A razor blade unit according to claim 1 further including a molded plastic housing providing a guard portion and a cap portion between which said first blade, said spacer and said second blade are clamped under compression to form a razor cartridge.

* * * * *